United States Patent [19]

Marforio et al.

[11] 4,098,202

[45] Jul. 4, 1978

[54] WORKPIECE GUIDE FOR SEWING MACHINES

[75] Inventors: Nerino Marforio, Milan; Pietro Bonalumi, Cernusco sul Naviglio (Milan), both of Italy

[73] Assignee: Rockwell-Rimoldi S.p.A., Milan, Italy

[21] Appl. No.: 790,445

[22] Filed: Apr. 25, 1977

[30] Foreign Application Priority Data

May 7, 1976 [IT] Italy ..... 23067 A/76

[51] Int. Cl.[2] ..... D05B 23/00; D05B 35/10

[52] U.S. Cl. ..... 112/20; 112/149; 112/153

[58] Field of Search ..... 112/20, 19, 18, 16, 112/153, 136, 149

[56] References Cited

U.S. PATENT DOCUMENTS

| | | | |
|---|---|---|---|
| 645,539 | 3/1900 | Allen | 112/149 |
| 678,928 | 7/1901 | Allen | 112/149 |
| 770,768 | 9/1904 | Cunningham | 112/149 |
| 1,559,267 | 10/1925 | Lipschitz | 112/20 X |
| 2,588,281 | 3/1952 | Olday | 112/20 |
| 3,570,425 | 3/1971 | Shulman et al. | 112/20 |

*Primary Examiner*—H. Hampton Hunter

[57] ABSTRACT

A guide for directing two pieces of fur to the stitching instrumentalities of a sewing machine for joining one to the other. The guide includes a funnel shaped element having channels formed adjacent its narrowest end that are separated by a depending guide plate. A source of compressed air is directed into the channels and serves to maintain the fur on the upper portion of the two pieces in a position where it had been folded inwardly and downwardly between the pieces by the upper surfaces of the funnel shaped element and the depending guide plate.

1 Claim, 4 Drawing Figures

WORKPIECE GUIDE FOR SEWING MACHINES

BACKGROUND OF THE DISCLOSURE

The present invention relates to a workpiece guide for use on a sewing machine for joining fur pieces. The machine includes a feed mechanism having counter-rotating disks and a horizontal needle disposed transversally to the direction of feed of the workpiece.

When joining pieces of fur by stiching, it is necessary to turn the fur disposed adjacent the upper edges of these pieces inwardly so that it is not sewn into the seam and does not project outwardly therefrom.

This problem has only partially been solved by known guide devices which are provided with means for turning the fur inwardly before the pieces to be sewn are caused to move between the counter-rotating disks in the sewing zone.

However, owing to their particular configuration, the known devices have not been able to completely and satisfactorily fold the fur inwardly in the desired manner.

An attempt was also made to improve the effectiveness of the above-mentioned folding means by the addition of a compressed air jet which was directed so as to force the fur downwardly between the pieces to be sewn. This added feature did not completely solve the problem of maintaining the fur in the desired folded position for the jets are disposed forwardly of the folding means and sewing zone which results in a loss of complete effectiveness of the air as the pieces to be joined enter said sewing zone.

Additionally the air stream guiding devices operatively associated with these air jets have been unable to direct all of the air flow between the fur pieces to be joined and that which escapes disperses outwardly creating a certain amount of physical irritation for the operator.

As a result of air loss with the known devices conditions were created which were responsible for a reduction in the effectiveness of the air as well as what is considered excessive power consumption.

An object of the present invention is to correct the above-mentioned problems by a means which ensures that all the fur is folded inwardly by the folding means without necessitating any special attention on the part of the operator.

Another object is that of improving the effectiveness of air jets by reducing the power consumption of the same and minimizing the amount of air dispersion ineffective upon the workpieces.

SUMMARY OF THE INVENTION

These objects are all attained by means of the device according to the present invention which includes a combination of two angular elements, one for each piece of fur, symmetrically disposed with respect to a vertical plane. These angular elements have upper walls which converge towards one another and downwardly and lateral walls converging towards one another and toward counter-rotating disks so as to define a funnel-shaped element operatively associated with two parallel channels symmetrically disposed with respect to a vertical plane in front of the disks. These channels are formed by two substantially vertical walls, between which is disposed a depending guide plate. This guide plate is provided with an edge which is directed toward the angular elements and is adapted to cooperate with the vertical walls to fold the fur downwardly between the workpieces as the latter are caused to advance through the channels.

Another feature consists in that the edge of the guide plate has a curvilinear shape which forms a hollow or recess that is directed toward the angular elements.

Another feature is that the channels are provided at their upper part with a central horizontal element located above the upper edges of the pieces of fur which includes openings through which compressed air is directed. These openings are disposed intermediate the guide plate and the substantially vertical walls so as to provide downwardly directed flows of air.

These and other features will be made apparent in the course of the following description of a preferred but not exclusive embodiment of the invention provided with reference to the accompanying non-limitative drawings, in which:

DESCRIPTION OF THE PREFERRED EMBODIMENT

Figure 1:
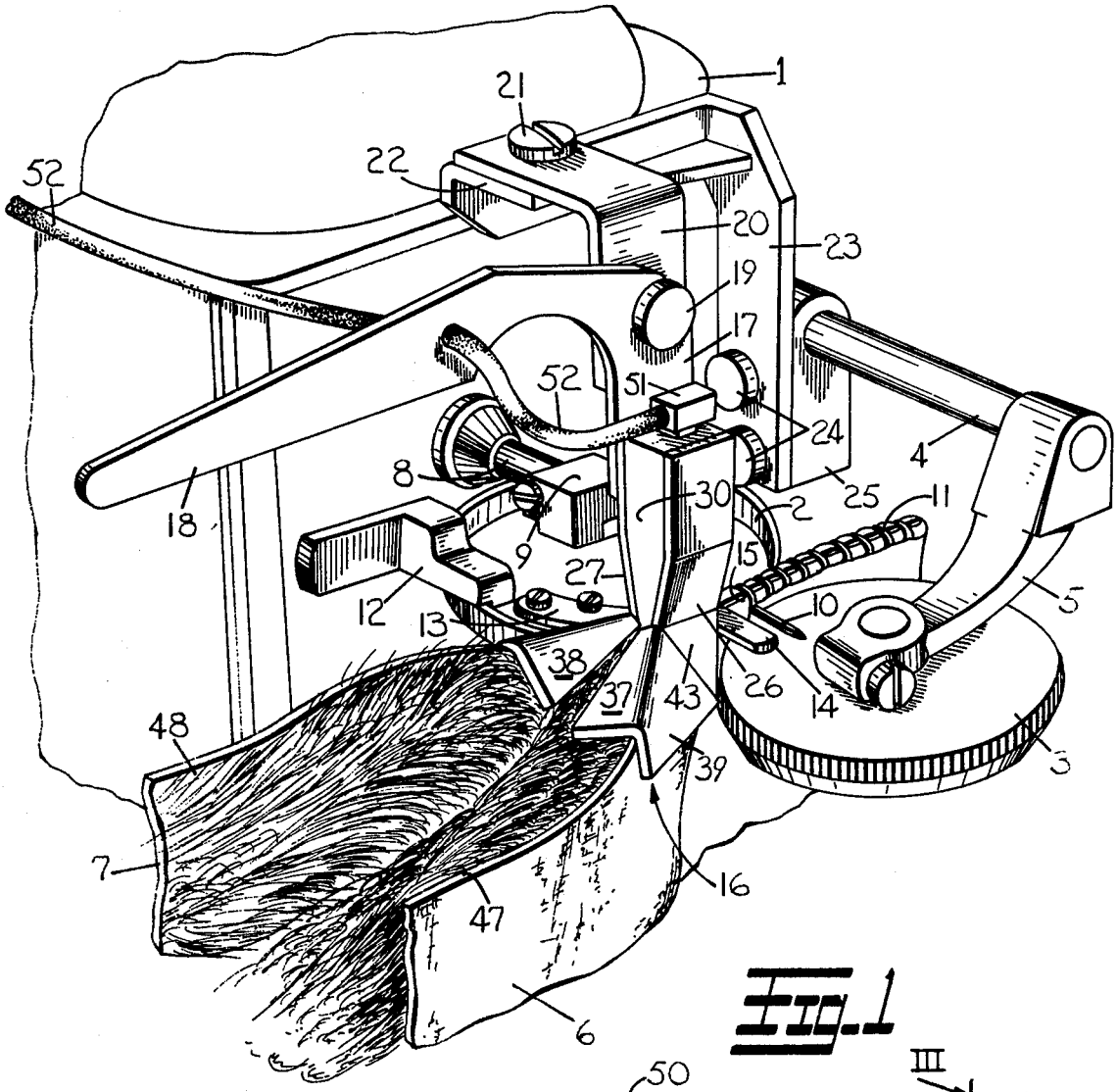
FIG. 1 is a perspective view of the device according to the invention assembled on a sewing machine.

Referring now to FIG. 1, numeral 1 designates the frame of a machine for sewing furs which includes a conventional feed means consisting of a driven disk 2 and a rotatable disk 3 which is biased in a conventional manner against the driven disk 2 to effect counter-rotation thereof.

A support rod 4 extends from the frame 1 and has an arcuated arm 5 assembled on the free end thereof which serves to rotatably support the disk 3.

Rod 4 is axially displaceable by a suitable control means (not shown) for the purpose of moving the disk 3 away from the disk 2 so as to enable an operator to insert two pieces of fur 6 and 7 constituting a workpiece between the disks prior to the start of each sewing operation.

The two pieces 6 and 7 are inserted between the disks with the fur portion of each in contact one with the other.

A needle bar 8 projecting from frame 1 is provided with a clamp 9 for holding a needle 10 which is caused to reciprocate transversally with respect to the vertical feed plane of a workpiece passing between the two disks 2 and 3. The sewing mechanism also includes a known form of hook (not shown) which cooperates with the needle 10 to form conventional stitches indicated by numeral 11.

The frame also includes a support bracket 12, to which is attached a conventional plate 13 whose end 14 serves to vertically locate the upper edges 15 of the fur pieces to be sewn with respect to the needle 10.

The workpiece guide comprising the invention is identified generally by numeral 16 and is disposed forwardly of the end 14 of the plate 13 in a position immediately adjacent to the workpiece feed-in zone of the counter-rotating disks. The workpiece guide 16 is supported by a lever 17 having a handle 18. The lever 17 is pivotally mounted on a horizontal pin 19 and serves as a means to remove the guide device 16 from operative association with the counter-rotating disks 2 and 3.

Pivotal movement of lever 17 about pin 19 causes the guide 16 to be tilted upwardly and away from the disks. The horizontal pin 19 is mounted on a support bracket 20 which in turn is pivotally carried on a vertical pin 21 and provides a means whereby the guide 16 can be pivoted to an inoperative position.

By rotating the support bracket 20 about pin 21, the guide device is moved away from the disks and toward the frame 1 of the machine. In this position it does not interfere with the workpiece to be sewn or with the operator's hands The vertical pin 21 is fixed to a horizontal plate 22 of a support member 23 that is attached by means of screws 24, to a part 25 of the frame.

Figure 2:
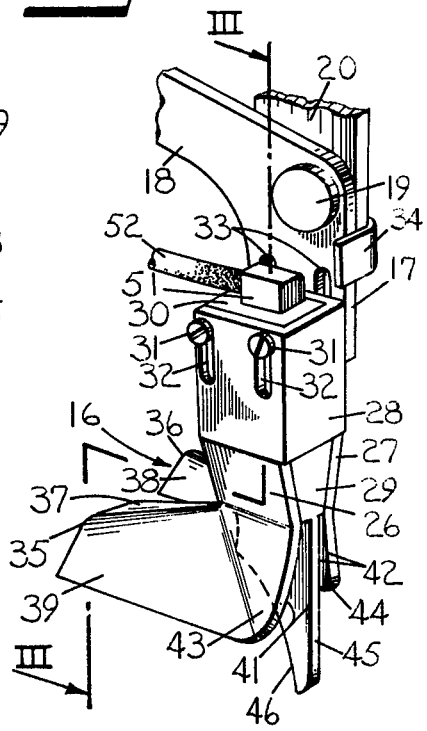
FIG. 2 is a perspective view of the guide device viewed from the sewing zone.

Referring now to FIG. 2, the guide device 16 includes two plates 26 and 27 which are interconnected by means of a plate element 28 that serve to house a central element 29 having an upper surface 30 which is supported by two screws 31 that extend through aligned holes 32 provided in the plates 26 and 27. These screws 31 serve as a means for attaching the central element 29 and the plates 26 and 27 to the lever 17. The holes 32 are elongated and provide a means which permits the plates 26 and 27 to be adjusted vertically with respect to the central element 29.

The central element 29 is interconnected with the lever 17 in a manner similar to the plates, that is, the screws 31 extend through corresponding slots 33 provided in the lever 17 such that this central element can also be vertically adjusted with respect to the end 14 of the conventional plate 13.

As shown in FIG. 2, the lower part of the support bracket 20 is provided with a stop tongue 34 which is engaged by the lever 17 when the guide 16 is positioned vertically in front of the counter-rotating disks 2 and 3 so as to exert its guiding action on the workpiece.

The plates 26 and 27 each include an angular element 35 and 36, respectively which are symmetrically disposed with respect to the vertical feed plane of the workpiece and serve to direct the two pieces of fur 6 and 7 to be sewn towards the counter-rotating disks 2 and 3.

Figure 3:
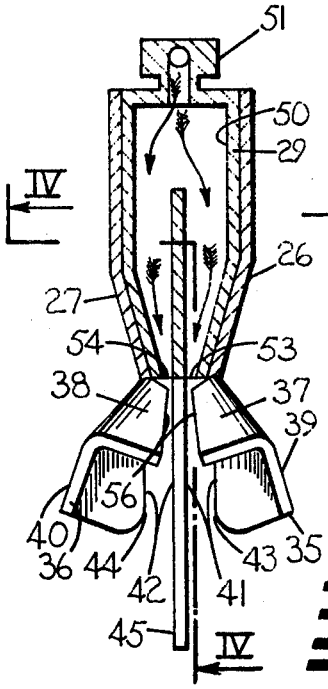
FIG. 3 is a sectional view of the guide device taken along line III—III in FIG. 2.
Figure 4:
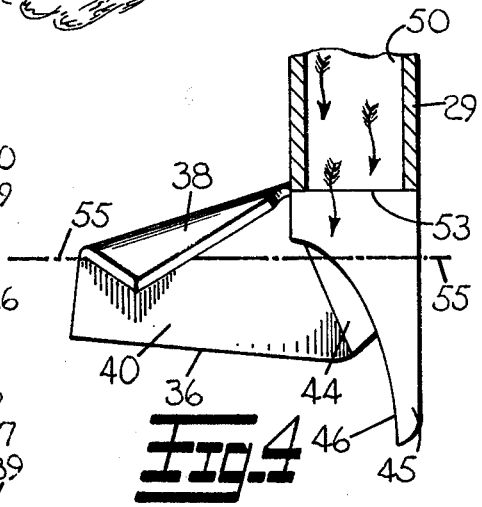
FIG. 4 is a sectional view of the guide device taken along line IV—IV in FIG. 3.

As shown in FIGS. 3 and 4, each of the angular elements 35 and 36 is provided with an upper wall 37 and 38, respectively which are directed inwardly and downwardly toward one another. These angular elements 37 and 38 also include lateral walls 39 and 40, respectively that are directed angularly downward and extend in a direction oblique to the direction of feed of the workpiece so that the ends disposed adjacent the disks 2 and 3 are positioned comparitively close relative to the opposite ends thereof.

The combination of these angular elements with their respective upper and lateral walls define a funnel shaped element having two parallel channels 41 and 42 located in close proximity to the disks 2 and 3 and are symmetrically disposed with respect to the aforementioned vertical plane.

Channels 41 and 42 are formed by substantially vertical walls 43 and 44 which form extensions of the lateral walls 39 and 40 respectively and by a depending guide plate 45 which is disposed intermediate said vertical walls 43 and 44.

The upper surface of the channels are formed by element 29 which also provides a means for supporting the depending guide plate 45.

The depending guide plate 45 is provided with an arcuated edge 46 which defines a curvilinear profile and forms that edge located adjacent to the angular elements 35 and 36. The depending guide plate 45 extends between and for substantially the entire horizontal distance of the vertical walls 43 and 44 and thus corresponds to the length of the channels 41 and 42.

The function of the upper walls 37 and 38 is that of turning the fur located adjacent to the upper edges 47 and 48 of the two pieces of fur 6 and 7 respectively downwardly and inwardly as they are advanced within the funnel-shaped element in the direction of the disks 2 and 3.

It is necessary to fold the fur in this manner so as to form a seam which will be free of projecting pieces of fur and not give an undesireable appearance to the finished workpiece.

The function of the lateral walls 39 and 40 is that of causing the pieces of fur 6 and 7 to converge toward the stiching instrumentalities and the depending guide plate 45 continues to urge that fur downwardly which was initially influenced by the upper walls 37 and 38. The additional folding influence on the fur is effected by the edge 46 prior to the fur of one piece coming into contact with the fur of the other piece at the exit end of the channels 41 and 42 and is also equally effective on those types of furs which are naturally difficult to fold.

The guide device 16 utilizes a source of compressed air to fold the fur as desired and to maintain it in a folded position. The compressed air is directed between the two pieces to be sewn and produces a downward thrust effect on the fur along the entire length of the depending guide plate 45.

The central element 29 includes an inner chamber 50 which is provided on its upper surface with an air intake member 51 that is interconnected by means of a feed line 52 to any suitable source of compressed air (not shown).

The lower surface of the central element 29 is provided with two openings 53 and 54 which are located between the depending guide plate 45 and the vertical walls 43 and 44 respectively. This arrangement locates opening 53 in operative association with channel 41 and opening 54 with channel 42.

The length and width of each opening 53 and 54 correspond substantially to the length and width of the channels 41 and 42 with which they communicate.

To ensure that the air emitted from the openings 53 and 54 performs its intended function efficiently said openings are disposed at a specific distance from the upper edges 47 and 48 of the workpiece during the latters movement through channels 41 and 42. The location of said edges is depicted in FIG. 4 by a line of dots and dashes 55.

The position of the edges 47 and 48 from the openings 53 and 54 is controlled, as shown in FIG. 4 at the feed-in end of the guide where the upper walls 37 and 38 are folded to form the lateral walls 39 and 40.

As a result, it is possible to supply through each opening a laminar air flow which cooperates with the guide plate over the entire portion of the channels which become open above the fur pieces.

Consequently, these laminar air flows only act on the fur that is in vertical alignment with the channels and does not escape at the ends of the fur pieces.

To prevent the formation of a low pressure zone in the area located beneath the upper walls 37 and 38, the latter are separated from one another by an elongated slot 56 which permits outside air to enter unrestricted into the funnel-shaped element.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A device for guiding two pieces of fur defining a workpiece to the stitching instrumentalities in a sewing machine of the type having a pair of counter-rotating disks for advancing the workpiece in a plane normal to the direction of movement of the machine's stitching needle, said device comprising:

(a) a pair of angular elements (35,36) symmetrically supported on the machine in operative association with the plane of advancement of the workpiece which includes:

(i) upper walls (37,38) respectively directed inwardly and downwardly one toward the other for folding the fur on the upper portion of the two pieces inwardly and downwardly between said pieces; and (ii) lateral walls (39,40) connected to said upper walls (37,38) respectively extending one toward the other in the direction of the rounter-rotating disks defining a funnel-shaped element;

(b) a pair of substantially vertical walls (43,44) connected to said lateral walls (39,40) respectively forming a continuation of said funnel-shaped element;

(c) means defining a depending guide plate (45) interposed between said vertical walls (43,44) forming parallel channels (41,42) therein having a length corresponding to the width of said depending guide plate (45) for separately guiding the pieces of fur toward the stitching instrumentalities;

(d) said depending guide plate (45) including an arcuated edge (46) defining a curvilinear profile for effecting a continued folding influence on the fur;

(e) means operatively connected to said channels (41,42) for subjecting the workpiece to downwardly directed flows of compressed air for maintaining the fur in its folded position during reception of the workpiece by the rotating disks; and (f) a central element (29) forming the upper portion of said channels (41,42) having spaced sidewalls disposed in operative association with said depending guide plate (45) defining openings (53,54) through which said downwardly directed flows of compressed air are emitted and said openings (53,54) correspond dimensionally to the length and width of said channels and in combination with said depending guide plate (45) and compressed air produce laminar air flows throughout the entire aligned area between said openings and the upper edges of the two pieces of fur in vertical alignment therewith.

* * * * *